United States Patent [19]

Wood

[11] Patent Number: 5,016,819

[45] Date of Patent: May 21, 1991

[54] ELECTROMAGNETIC FUEL INJECTOR HAVING SPLIT STREAM FLOW DIRECTOR

[75] Inventor: Ross W. Wood, Newport News, Va.

[73] Assignee: Siemens-Bendix Automotive Electronics L.P., Auburn Hills, Mich.

[21] Appl. No.: 383,386

[22] Filed: Jul. 20, 1989

[51] Int. Cl.[5] ..... B05B 1/26

[52] U.S. Cl. ..... 239/522; 239/585

[58] Field of Search ..... 239/533.3, 533.12, 520, 239/524, 585, 522

[56] References Cited

U.S. PATENT DOCUMENTS

| | | | |
|---|---|---|---|
| 4,657,189 | 4/1987 | Iwata et al. | 239/585 |
| 4,699,323 | 10/1987 | Rush et al. | 239/585 |
| 4,773,374 | 9/1988 | Kiuchi et al. | 239/533.12 X |
| 4,813,610 | 3/1989 | Renowden | 239/585 X |
| 4,854,024 | 8/1989 | Grieb et al. | 29/156 |
| 4,971,948 | 9/1989 | Furukawa et al. | 239/585 X |

*Primary Examiner*—Andres Kashnikow
*Assistant Examiner*—Kevin Weldon
*Attorney, Agent, or Firm*—George L. Boller; Russel C. Wells

[57] ABSTRACT

A fuel injector comprises a tip end containing a flat planar orifice member that is sandwiched between a seat member and a flow director member. The thin disc orifice member contains a pair of metering orifices that receive fuel that has been allowed to pass through the seat member by virtue of the unseating of the injector needle. The fuel is emitted from the metering orifices as two parallel streams that are parallel to the injector centerline. The flow director member contains a pair of holes having wall portions arranged to cause the flow streams to be emitted from the injector tip as two streams that diverge from the injector centerline without any additional influence on the metering.

9 Claims, 2 Drawing Sheets

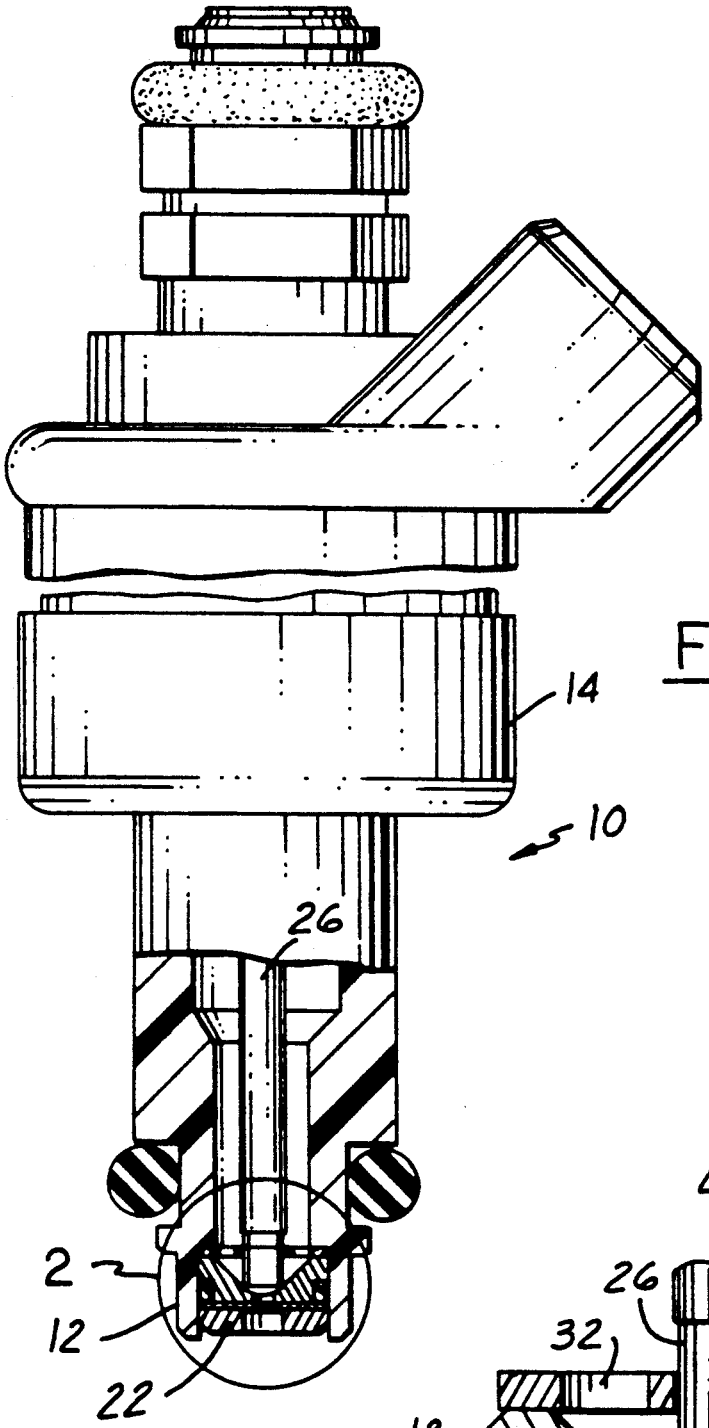
FIG. 1
FIG. 2
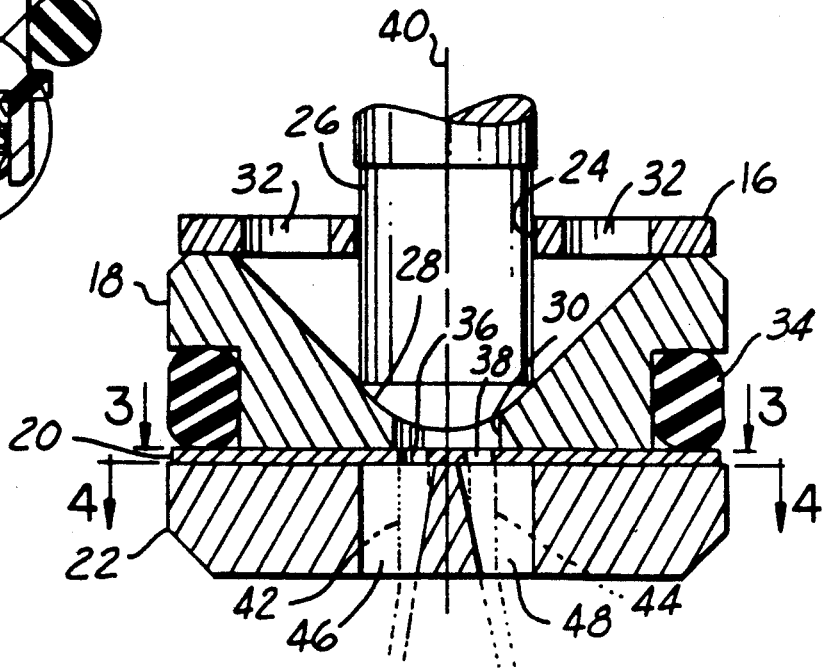

ELECTROMAGNETIC FUEL INJECTOR HAVING SPLIT STREAM FLOW DIRECTOR

BACKGROUND AND SUMMARY OF THE INVENTION

This invention relates generally to electromagnetic fuel injectors of the type used with internal combustion engines. More specifically, it relates to an improvement in a split stream injector.

In an internal combustion engine that has one fuel injector per cylinder, but two intake valves per cylinder, the use of electromagnetic fuel injectors that direct the fuel in separate and distinct paths to each intake valve has been proven to improve the performance and efficiency of the engine. The prior art is represented by U.S. Pat. Nos. 4,657,189 and 4,699,323, both of which are concerned with injectors that direct fuel in two different directions.

The design of the injector of U.S. Pat. No. 4,657,189 is such that the flow is both divided and directed downstream of a metering orifice. A disadvantage of such design is that the flow will not be equally divided if there is misalignment between the metering orifice centerline and the flow splitter/director centerline. For given manufacturing tolerances, such misalignment cannot be avoided in many injectors and therefore it becomes difficult to obtain consistency from injector to injector when the injectors are mass produced.

The injector of U.S. Pat. No. 4,699,323 uses six holes to generate two hollow cones, or plumes. Three of these holes both direct and meter the flow that is used to create one plume while the other three holes do the same for the other plume. If the centerline of the injector is the Z-axis, then the alignment angle of two of the three holes of each set must be controlled in both the X-axis and the Y-axis in order to produce the hollow cone pattern. Moreover, the sizes of the holes must be precisely controlled to attain the desired cone-to-cone distribution. For given manufacturing tolerances in mass production, such controls are difficult to achieve, and therefore mass production consistency from injector to injector is unlikely.

The present invention provides an electromagnetic fuel injector that is not beset by difficulties such as those that have just been described. The invention contemplates that the splitting and metering functions be contemporaneously performed by a flat thin disc orifice member located at the tip end of the injector. This thin disc orifice member can be easily manufactured with a suitable degree of precision. Direction of the split and metered parallel fuel flows is accomplished by a flow director member that is also at the injector tip, just downstream of the thin disc orifice member. The flow director member has holes arranged such that the flow from each orifice of the thin disc orifice member is directed off a wall portion of a corresponding flow director hole without the flow director holes altering the metering of the fuel. In other words, the flow director member performs only a direction function that directs the incoming parallel flows from the thin disc orifice member to outgoing flows that diverge at a desired included angle. The injector of the invention performs consistently well under both static (always flowing) and dynamic (on/off cycling) operations without degrading the spray angle. The injector of the invention has the further advantage of allowing the splitting, metering and directing functions to be relatively economically incorporated. For example, it is contemplated that the flow director member can be fabricated from a structural (high modulus of elasticity) plastic that can be injection molded.

The foregoing features, advantages, and benefits of the invention, along with additional ones, will be seen in the ensuing description and claims which should be considered in conjunction with the accompanying drawings. The drawings disclose a preferred embodiment of the invention in accordance with the best mode contemplated at the present time for carrying out the invention.

BRIEF DESCRIPTION OF THE DRAWINGS

FIG. 1 is an elevational view, partly in section, of a fuel injector embodying the present invention.

FIG. 2 is an enlarged view of the tip end of the injector as taken in circle 2 of FIG. 1.

DESCRIPTION OF THE PREFERRED EMBODIMENT

Figure 3:
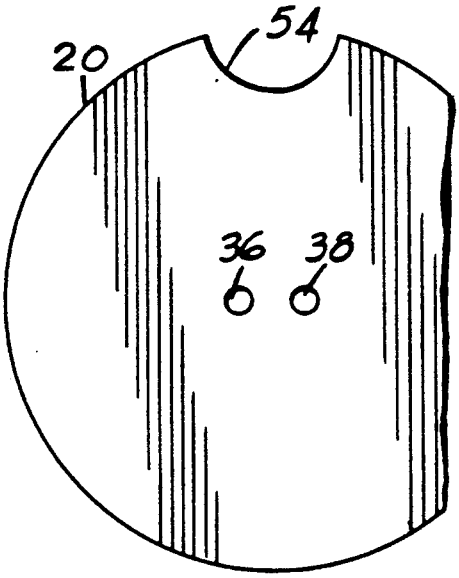
FIG. 3 is a view taken in the direction of arrows 3—3 in FIG. 2.

In FIG. 1 the electromagnetic fuel injector of the invention is designated by the reference numeral 10 and comprises a tip end 12 at which pressurized fuel that has been supplied to the injector inlet is emitted. The emission of fuel is controlled by the energization of an electromagnetic coil 14.

Details of the tip end 12 can be seen in FIG. 2. Fixedly located on the injector tip end are a guide member 16, a seat member 18, a thin orifice disc member 20, and a split stream flow director member 22. Guide member 16 comprises a central circular guide hole 24 for accurately guiding a needle 26 for axial motion with respect to a seat 28 that is centrally formed in seat member 18. Member 16 is affixed to member 18 such that hole 24 is aligned with seat 28. FIG. 2 shows the rounded tip end of needle 26 seated on seat 28 so that flow through a central hole 30 through the seat member is prevented. When coil 14 is energized, needle 26 is unseated from seat 28 permitting flow through hole 30, and when the coil is de-energized, the needle re-seats on the seat blocking flow through hole 30. Guide member 16 has holes 32 spaced outwardly of hole 24 so that fuel can pass through the guide member toward hole 30. An elastomeric O-ring 34 is disposed about seat member 18 to seal between the seat member and the wall of the tip end.

Thin disc orifice member 20 comprises two circular orifices 36, 38 that perform the fuel splitting and metering functions. These orifices are located 180 degrees apart about the centerline of hole 30 which coincides with the centerline 40 of the injector. Orifices 36, 38 lie wholly within the boundary of hole 30. By making the orifices identical in size, two identical flow streams 42, 44 are created when needle 26 is unseated from seat 28. These flow streams are emitted from the orifices as two separate and distinct jets that are parallel to centerline 40.

Split stream flow director member 22 comprises two holes 46, 48 that are arranged such that portions of their respective walls act upon the incoming parallel flow streams 42, 44 to cause the flow streams to diverge at a particular included angle as they leave tip end 12. The holes 46, 48 comprise respective frusto-conically shaped wall portions 50, 52 against which the parallel flow streams are directed. By making the angles of the wall portions identical, but opposite, relative to respective axes that are parallel to centerline 40, each flow stream 42, 44 will be directed away from centerline 40 at the same angle relative to centerline 40, but in the opposite direction from the other. In any given fuel injector, holes 46, 48 are designed to produce the desired angles for the particular engine application.

Figure 4:
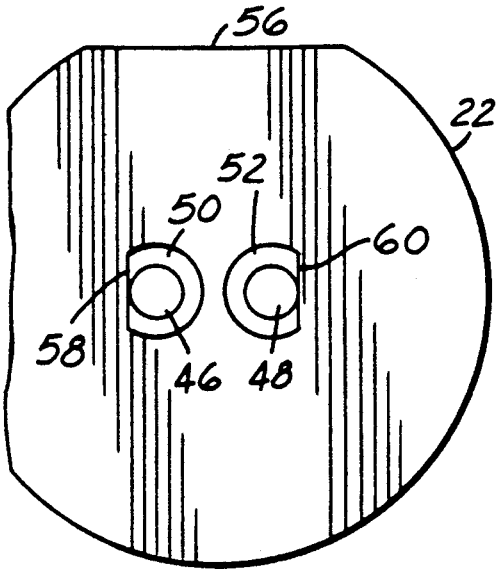
FIG. 4 is a view taken in the direction of arrows 4—4 in FIG. 2.

FIGS. 3 and 4 show top plan views of members 20 and 22. In these two views it can be seen that each member has a respective notch 54, 56 in its edge. These notches are used for assembly purposes to secure proper circumferential alignment of the two members which is necessary to yield the desired orientation of holes 46, 48 to orifices 36, 38. It is to be observed that holes 46, 48 are not fully frusto-conical, but rather are flattened to what is called a "ground cone" configuration wherein the frusto-conical tapers terminate in planes 58, 60 that are parallel to the injector centerline 40. This is useful in allowing member 22 to be fabricated as an injection molded structural plastic part.

Figure 5:
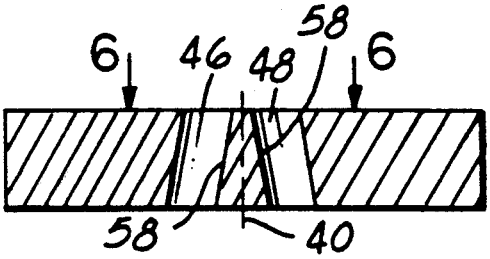
FIG. 5 is a diametrical cross sectional view of another embodiment of a flow director member.
Figure 6:
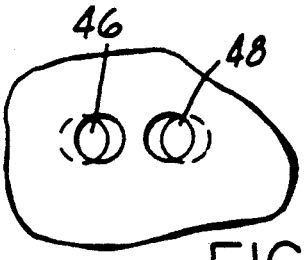
FIG. 6 is a fragmentary top view of FIG. 5.

FIGS. 5 and 6 portray another embodiment of member 22 wherein holes 46, 48 are circular in shape with their respective axes inclined relative to centerline 40, and wherein member 22 has a uniform thickness throughout.

Figure 7:
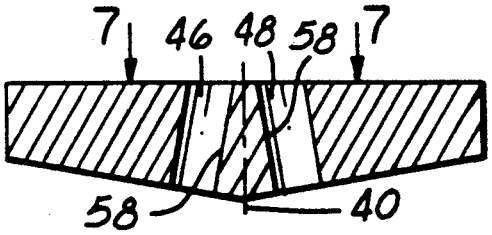
FIG. 7 is a diametrical cross sectional view of another embodiment of a flow director member.
Figure 8:
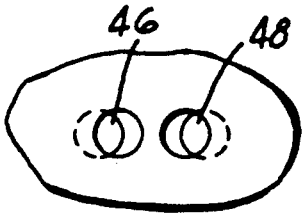
FIG. 8 is a fragmentary top view of FIG. 7.

FIGS. 7 and 8 show an embodiment of member 22 wherein holes 46, 48 are also circular in shape with their respective axes inclined relative to centerline 40, but with member 22 having a cone-shaped downstream face. In both embodiments of FIGS. 5 and 7, the flow streams will impinge upon the hole walls in the regions designated by the numerals 58.

Figure 9:
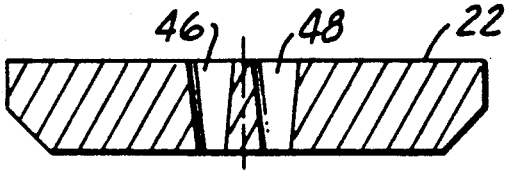
FIG. 9 is a diametrical view of another embodiment.

FIG. 9 shows an embodiment of member 22 wherein holes 46, 48 are of "full" frusto-conical shape. Each flow stream is directed off the "inside" of each hole wall, as in the embodiment of FIG. 4. The FIG. 9 embodiment is advantageous for part simplicity for production.

In all embodiments of the invention, holes 46, 48 are sufficiently large in relation to orifices 36, 38 so that holes 46, 48 do not influence the metering function. By way of example an injector may be constructed with the orifice member of 0.003 inch thick stainless steel, orifices 36, 38 of 0.014 inch diameter, member 22 of 0.060 inch thick stainless steel, and holes 46, 48 of 0.025 inch diameter at an included angle of 20 degrees.

While a preferred embodiment of the invention has been disclosed and described, it will be appreciated that principles are applicable to other embodiments.

What is claimed is:

1. In an electromagnetic fuel injector wherein liquid fuel under pressure is introduced into the injector body and thereafter emitted from the injector body at a tip end, said tip end containing a seat member having a seat bounding a hole through which fuel emitted by the injector must pass before being emitted from the injector tip end, said injector having a needle that is operated by an electromagnetic coil and coacts with said seat to control fuel flow through said hole, and a thin disc orifice member disposed at said tip end downstream of said seat member, the improvement comprising said thin disc orifice member containing plural orifices that meter fuel that has passed through said hole such that the metered fuel is emitted from the orifices as parallel flow streams, and a flow director member disposed at said tip end downstream of said thin disc orifice member, said flow director member having plural holes through which the respective flow streams from said orifices pass before being emitted from the injector, each orifice being in communication with a corresponding one of aid flow director member holes, each flow director member hole having an entrance whose periphery is abutted with the corresponding orifice so that the stream from each orifice does not pass to any of said flow director member holes other than the corresponding flow director member hole, at least one of said flow director member holes having a curved wall portion disposed in the path of the corresponding flow stream from the corresponding orifice to direct such corresponding flow stream in diverging relation both to the direction from which it entered said at least one hole and to another of the flow streams exiting another of said flow director holes, said flow director member holes being sized so as to impose substantially no metering effect on the flow streams through them.

2. The improvement set forth in claim 1 in which there are two of said orifices and two of said flow director member holes which are arranged such that the flow streams emitted from the injector diverge from the injector tip end in opposite directions at diverging angles from the injector centerline.

3. The improvement set forth in claim 2 in which said two orifices are 180 degrees apart about the injector centerline and said two flow director member holes are also 180 degrees apart about the injector centerline.

4. In an electromagnetic fuel injector wherein liquid fuel under pressure is introduced into the injector body and thereafter emitted from the injector body at a tip end, said tip end containing a seat member having a seat bounding a hole through which fuel emitted by the injector must pass before being emitted from the injector tip end, said injector having a needle that is operated by an electromagnetic coil and coacts with said seat to control fuel flow through said hole, and a thin disc orifice member disposed at said tip end downstream of said seat member, the improvement comprising said thin disc orifice member containing plural orifices that meter fuel that has passed through said hole such that the metered fuel is emitted from the orifices as parallel flow streams, and a flow director member disposed at said tip end downstream of said thin disc orifice member, said flow director member having plural holes through which the respective flow streams from said orifices pass before being emitted from the injector, at least one of said flow director member holes having a wall portion disposed in the path of the corresponding flow stream from the corresponding orifice to direct such corresponding flow stream in diverging relation to the direction from which it entered said at least one hole, said flow director member holes being sized so as to impose substantially no metering effect on the flow streams through them, in which there are two of said orifices and two of said flow director member holes which are arranged such that the flow streams emitted from the injector diverge from the injector tip end in opposite directions at diverging angles from the injector centerline, in which said two orifices are 180 degrees apart about the injector centerline and said two flow director member holes are also 180 degrees apart about the injector centerline, and in which each of said two flow director member holes has a frusto-conical tapered wall portion that narrows in the downstream direction of flow and the axis of the frusto-conical tapered wall portion is parallel to the centerline of the injector, such frusto-conical tapered wall portions being the respective wall portions of said flow director member holes that direct the respective flow streams.

5. The improvement set forth in claim 4 in which said two flow director member holes' tapered wall portions do not extend fully circumferentially around the respective holes, but rather terminate at respective planar wall portions that lie in planes parallel to the injector centerline.

6. The improvement set forth in claim 2 in which said two flow director member holes are of circular cross-sections that are inclined at angles to the centerline of the injector.

7. The improvement set forth in claim 2 in which said thin disc orifice member is a flat planar member that is sandwiched between said seat member and said flow director member.

8. The improvement set forth in claim 4 in which said two flow director member holes' tapered wall portions extend fully circumferentially around the respective holes.

9. In an electromagnetic fuel injector wherein liquid fuel under pressure is introduced into the injector body and thereafter emitted from the injector body at a tip end, said tip end containing a seat member having a seat bounding a hole through which fuel emitted by the injector must pass before being emitted from the injector tip end, said injector having a needle that is operated by an electromagnetic coil and coacts with said seat to control fuel flow through said hole, and a thin disc orifice member disposed at said tip end downstream of said seat member, the improvement comprising said thin disc orifice member containing plural orifices that meter fuel that has passed through said hole such that the metered fuel is emitted from the orifices as parallel flow streams, and a flow director member disposed at said tip end downstream of said thin disc orifice member, said flow director member having plural holes through which the respective flow streams from said orifices pass before being emitted from the injector, at least one of said flow director member holes having a frusto-conical tapered wall portion that narrows in the downstream direction of flow and whose axis is parallel to the centerline of the injector, such frusto-conical tapered wall portion being disposed in the path of the corresponding flow stream from the corresponding orifice to direct such corresponding flow stream in diverging relation both to the direction from which it entered said at least one hole and to another of the flow streams exiting another of said flow director member holes, said flow director member holes being sized so as to impose substantially no metering effect on the flow streams through them.

* * * * *